US008421683B2

(12) United States Patent
Mak et al.

(10) Patent No.: US 8,421,683 B2
(45) Date of Patent: Apr. 16, 2013

(54) ROLLABLE AND/OR FOLDABLE ANTENNA SYSTEMS AND METHODS FOR USE THEREOF

(75) Inventors: Chi Lun Mak, Ma On Shan (HK); Hau Wah Lai, Lam Tin (HK); Corbett R. Rowell, Mongkok (HK)

(73) Assignee: Hong Kong Applied Science and Technology Research Institute Co., Ltd., Hong Kong (CN)

( * ) Notice: Subject to any disclaimer, the term of this patent is extended or adjusted under 35 U.S.C. 154(b) by 793 days.

(21) Appl. No.: 12/491,685

(22) Filed: Jun. 25, 2009

(65) Prior Publication Data

US 2010/0328171 A1 Dec. 30, 2010

(51) Int. Cl.
*H01Q 1/24* (2006.01)

(52) U.S. Cl.
USPC ..... 343/702; 343/700 MS; 343/895

(58) Field of Classification Search ..... 343/702, 343/895, 846, 700 MS
See application file for complete search history.

(56) References Cited

U.S. PATENT DOCUMENTS

| | | | | |
|---|---|---|---|---|
| 3,165,751 | A | 1/1965 | Clark | |
| 3,577,196 | A | 5/1971 | Pereda | |
| 3,631,505 | A | 12/1971 | Carman et al. | |
| 4,041,498 | A | 8/1977 | Freimark et al. | |
| 4,743,917 | A | 5/1988 | Huntsman et al. | |
| 4,868,576 | A | 9/1989 | Johnson, Jr. | |
| 5,079,558 | A | 1/1992 | Koike | |
| 5,274,393 | A | 12/1993 | Scott | |
| 5,313,221 | A | 5/1994 | Denton, Jr. | |
| 5,343,213 | A | 8/1994 | Kottke et al. | |
| 5,374,937 | A | 12/1994 | Tsunekawa et al. | |
| 5,513,383 | A | 4/1996 | Tsao | |
| 5,661,496 | A | 8/1997 | Baek et al. | |
| 6,140,970 | A | 10/2000 | Ylijurva | |
| 6,531,986 | B2 | 3/2003 | Saito | |
| 6,756,943 | B2 | 6/2004 | Kim et al. | |
| 7,339,530 | B2 * | 3/2008 | Ying et al. | 343/702 |
| 7,573,426 | B2 * | 8/2009 | Amano et al. | 343/702 |
| 7,586,461 | B2 * | 9/2009 | Miyoshi et al. | 343/895 |
| 2002/0190904 | A1 * | 12/2002 | Cohen | 343/700 MS |
| 2004/0207560 | A1 * | 10/2004 | Knapp | 343/705 |
| 2007/0040758 | A1 * | 2/2007 | Dwyer et al. | 343/792 |

* cited by examiner

*Primary Examiner* — Hoanganh Le
(74) *Attorney, Agent, or Firm* — Fulbright & Jaworski L.L.P.

(57) ABSTRACT

An antenna system comprises a ground plane, a flexible substrate, a first antenna element disposed upon the flexible substrate and proximal to the ground plane, the flexible substrate configured so as to be at least partially rolled, and a Radio Frequency (RF) module in communication with the first antenna element and transmitting and receiving radio waves through the first antenna element.

13 Claims, 8 Drawing Sheets

ROLLABLE AND/OR FOLDABLE ANTENNA SYSTEMS AND METHODS FOR USE THEREOF

TECHNICAL FIELD

The present description relates generally to antenna systems and methods for use thereof and relates, more specifically, to antenna systems employing rolled and/or folded antennas and methods for use thereof.

BACKGROUND

Various systems exist currently for implementing reconfigurable antennas. One example is a group of closely spaced patches, where the patches are connected by switches. By opening some switches and closing other switches, the electromagnetic geometry and antenna performance are changed. However, the physical geometry stays the same.

In another example of an existing device, an antenna is connected to a ground and/or a feed through one or more switches. As some switches are opened and other are closed, the electromagnetic properties (e.g., resonant frequency, gain, etc.) of the antenna are changed as well. Once again, the physical geometry stays the same.

A different type of antenna is a telescoping antenna, such as is used with portable radios and televisions. Such antennas are typically monopole antennas constructed of concentric metal tubes that can be pulled out to provide length or retracted to provide compactness. A user can extend the antenna during operation and retract the antenna for storage. Generally, telescoping antennas provide better performance at or near their maximum lengths and often provide adequate performance even when retracted (though the general rule is that the natural resonant frequency will be shifted as the length changes). Currently, however, there is no antenna available that provides acceptable compactness and performance when the antenna is disposed upon a substrate and operates at the same band when compact or expanded.

BRIEF SUMMARY

Various embodiments of the invention are directed to antenna systems that include antenna elements disposed upon flexible substrates, the antenna elements providing performance within a communication band when the substrate is rolled and unrolled (or folded and unfolded). Various embodiments of the invention are directed to methods for use of such antennas, including operating within a particular communication band in an unrolled (or unfolded) configuration and operating within the same communication band in a rolled (or folded) configuration.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
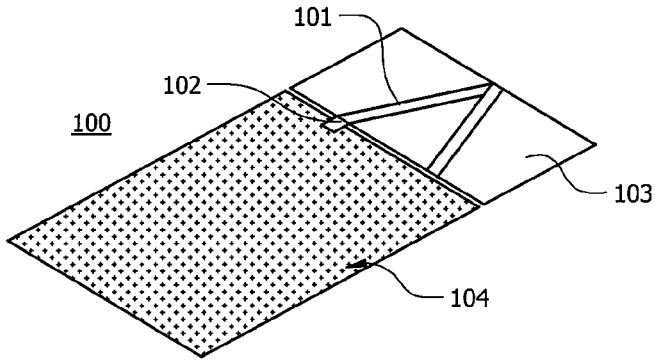
FIG. 1 is an illustration of an exemplary antenna, adapted according to one embodiment of the invention.

FIG. 1 is an illustration of exemplary antenna 100, adapted according to one embodiment of the invention. Antenna 100 includes ground plane 104, which is placed near to antenna element 101, allowing antenna element 101 to function as a monopole-type antenna. Antenna element 101 includes Radio Frequency (RF) feed 102, which is in communication with an RF circuit (not shown for ease of illustration) that transmits and receives RF signals using antenna element 101.

Antenna element 101 is disposed upon flexible substrate 103. In one example, flexible substrate 103 is constructed of the material commonly referred to as "flexible PCB," and antenna element 101 is constructed as a metal trace thereon. Other embodiments may employ other materials for flexible substrate 103, such as any of a variety of plastics and/or may also employ other conductive materials for antenna element 101. In FIG. 1, antenna system 100 is shown in a flat, unrolled and unfolded configuration. Antenna system 100 is operable even when flexible substrate 103 is rolled or folded, as explained in more detail below with respect to FIGS. 3 and 4.

Figure 2A:
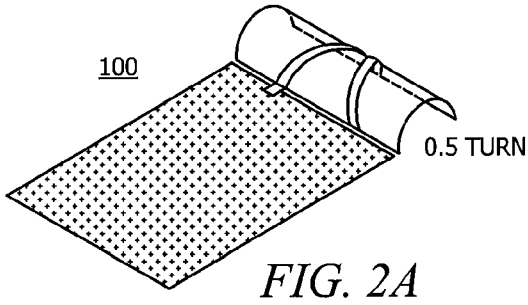
FIGS. 2A-D are illustrations of an exemplary antenna system in various degrees of rolling.
Figure 2B:
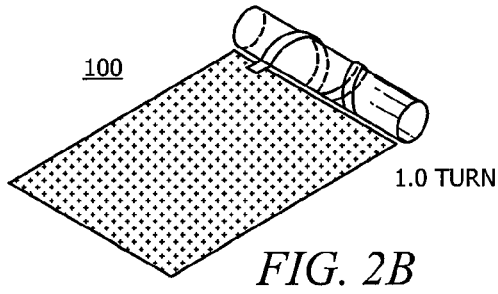
Figure 2C:
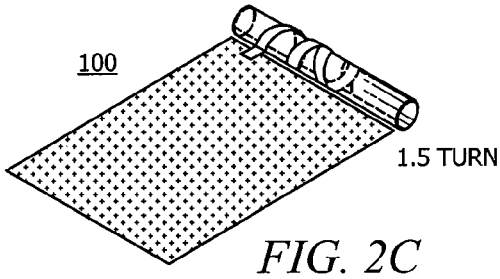
Figure 2D:
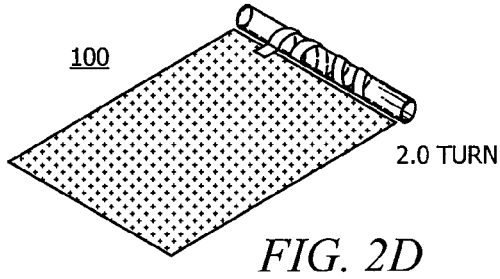

FIGS. 2A-D are illustrations of antenna system 100 of FIG. 1 in various degrees of rolling. In FIG. 2A, flexible substrate 103 is rolled in half of a turn. Similarly, in FIG. 2B, flexible substrate 103 is rolled in a full turn. FIGS. 2C and D show flexible substrate 103 rolled in one-and-a-half and two turns, respectively. Various embodiments can roll flexible substrates and antenna elements in any arbitrary number of turns consistent with the properties of the materials, even during operation.

An advantage of the embodiment of FIGS. 1 and 2A-D is that rolling flexible substrate 103 and antenna element 101 does not change the operating frequency of antenna system 100 so drastically that the operating frequency falls out of a band that is serviced by antenna element 101 in its unrolled configuration. Thus, antenna system 100 provides consistent service in a communication band whether rolled or unrolled.

Figure 3A:
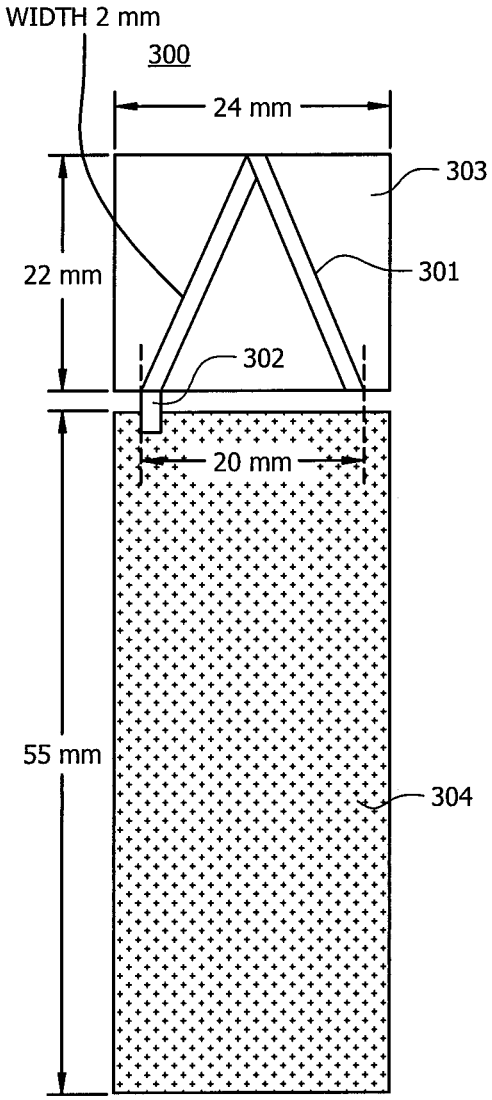
FIGS. 3A and 3B are illustrations of an exemplary antenna system, adapted according to one embodiment of the invention.
Figure 3B:
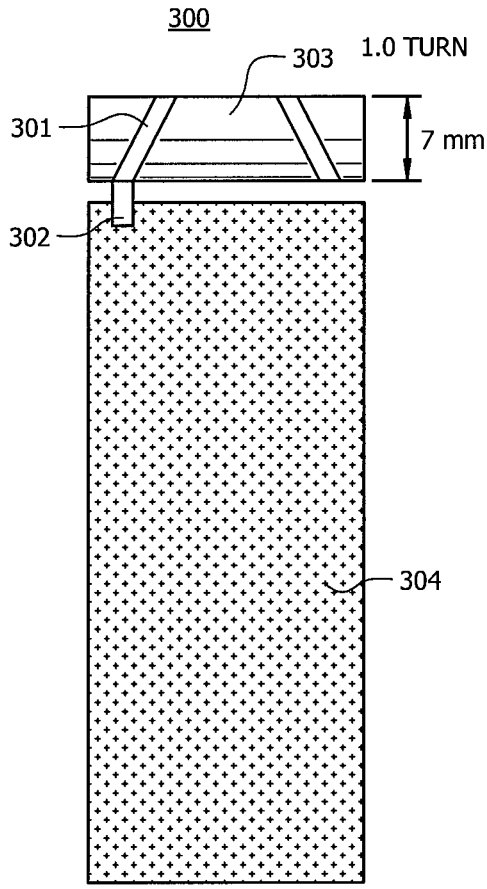

FIGS. 3A and 3B are illustrations of exemplary antenna system 300, adapted according to one embodiment of the invention. Antenna system 300 includes ground plane 304, flexible substrate 303, RF feed 302, and antenna element 301. FIGS. 3A and 3B provide dimensions of the embodiment in millimeters. While FIG. 3 shows specific dimensions, it is noted that various embodiments may include different dimensions, especially embodiments designed for different operating bands or for use in applications that have different dimensional constraints.

A notable feature of antenna system 300 is the inverted "V" shape of antenna element 301. Specifically, the conductive material of antenna element 301 follows a path that leads away from ground plane 304 near RF feed 302 and leads toward ground plane 304 at the end that is farthest from RF feed 302. The inverted "V" shape is one design that eliminates or minimizes overlap of the conductive path with itself when the antenna is rolled or folded. The inverted "V" shape of antenna element 301 allows antenna element 301 to provide operation in both rolled and unrolled configurations.

Figure 4:
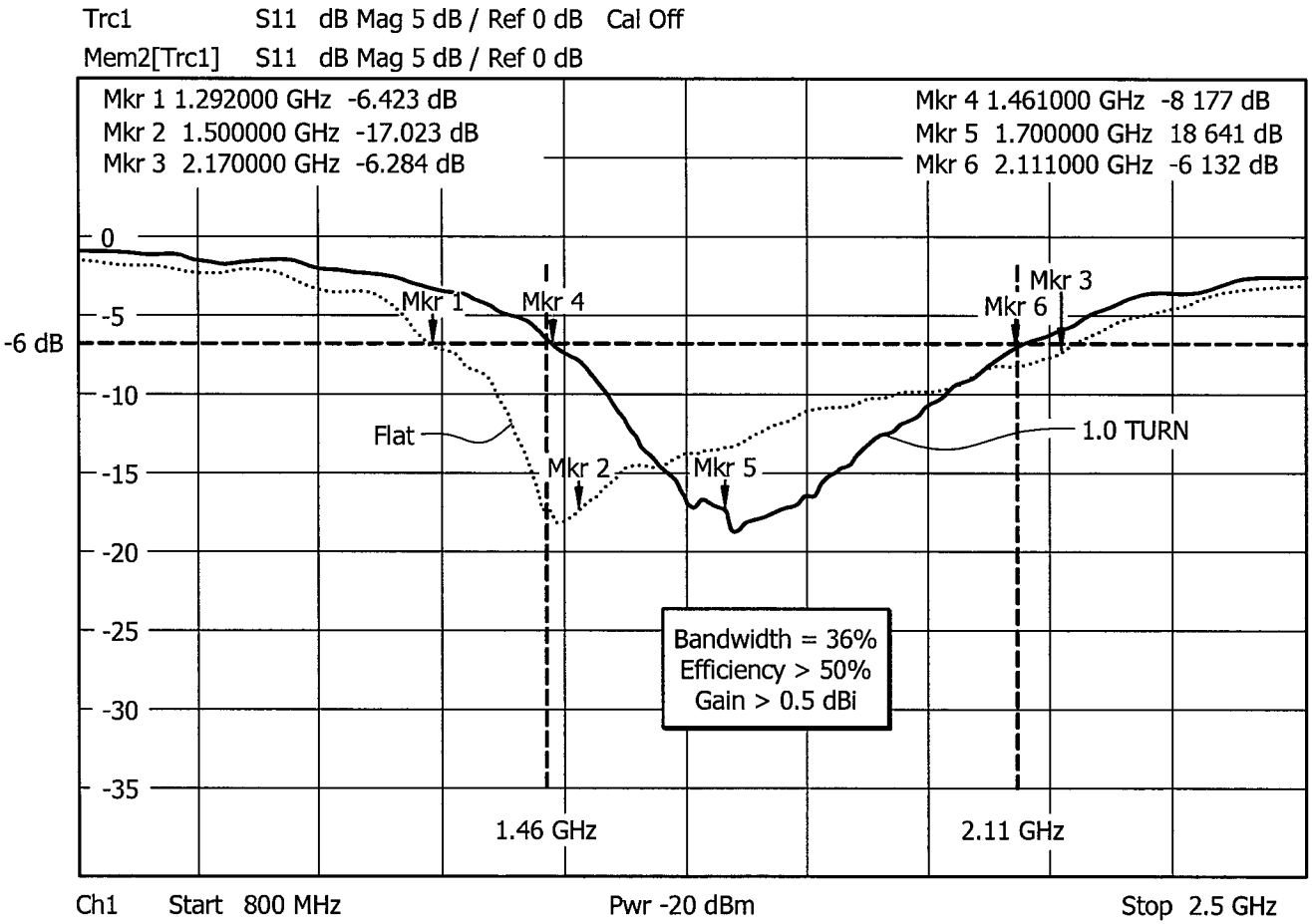
FIG. 4 is an illustration of a graph showing testing results of a prototype built according to the embodiment of FIG. 3.

A prototype according to the design of the embodiment of FIG. 3 has been built and tested, and the results are shown in the graph of FIG. 4. In the graph, the x-axis represents frequency, and the y-axis represents return loss (S11). As can be seen, operation of the antenna in a flat configuration is similar to operation of the antenna in a one-roll configuration, where the roll shifts the resonant frequency of the antenna up by about 0.2 GHz In the example of FIG. 4, satisfactory operation is shown by the line demarcating −6 dB of return loss, a common standard in the mobile phone industry, and the rolled and flat configurations have overlapping bands of satisfactory operation. Specifically, the flat configuration has a band of satisfactory operation from 1.29 GHz to 2.17 GHz, and the rolled configuration has a band of satisfactory operation from 1.46 GHz to 2.11 GHz. The overlapping percentage bandwidth, given by (2.11−1.46)/[(2.11+1.46)/2] is 36.414%, and the efficiency is greater than 50% even when rolled. Furthermore, while not shown in FIG. 4, it is noted that the gain of the rolled configuration is greater than 0.5 dBi, and the efficiency of the rolled configuration is above fifty percent (and gain and efficiency of the flat configuration is equal to or greater than that of the rolled configuration). Therefore, for discrete communication bands falling between 1.46 GHz and 2.11 GHz, the antenna shows satisfactory performance at least for a flat and for a single-rolled configuration and for any arbitrary configuration therebetween.

Figure 5A:
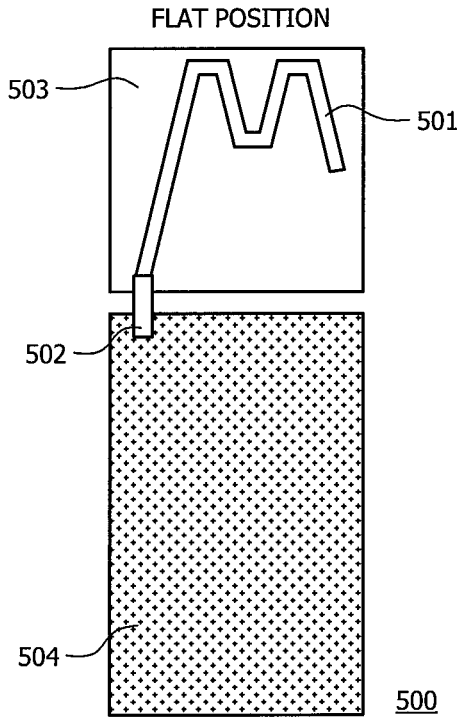
FIG. 5A is a top-view illustration of an exemplary antenna system adapted according to one embodiment of the invention, and FIG. 5B includes side-view illustrations of such exemplary antenna system in both a flat configuration and a rolled configuration.
Figure 5B:
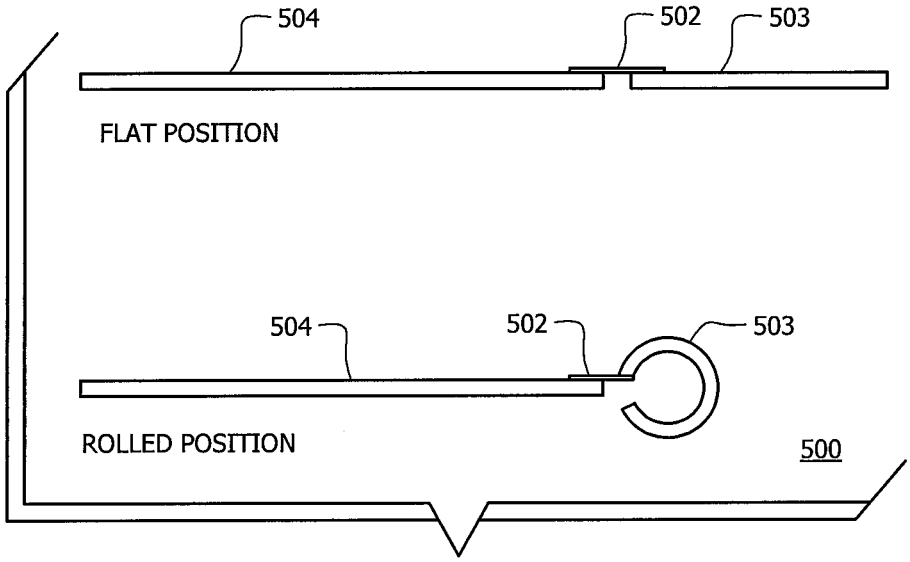

FIG. 5A is a top-view illustration of exemplary antenna system 500 adapted according to one embodiment of the invention, and FIG. 5B includes side-view illustrations of antenna system 500 in both a flat configuration and a rolled configuration. As the antenna is printed on one side of the flexible substrate 503, the antenna can be rolled inward or outward. In various embodiments, antenna element 501 can be disposed upon either or both sides of flexible substrate 503. Antenna system 500 includes ground plane 504, flexible substrate 503, antenna element 501, and RF feed 502. In contrast to the inverted V shape of the embodiments of FIGS. 1 and 3, system 500 employs a different shape for antenna element 501. Nevertheless, similarly to the embodiments of FIGS. 1 and 3, antenna element 501 has a shape that minimizes or eliminates overlap with itself when rolled or folded. FIGS. 5A and 5B illustrate that embodiments of the invention are not limited to the inverted "V" shape for antenna elements, as any of a variety shapes may be included in various embodiments.

Figure 6A:
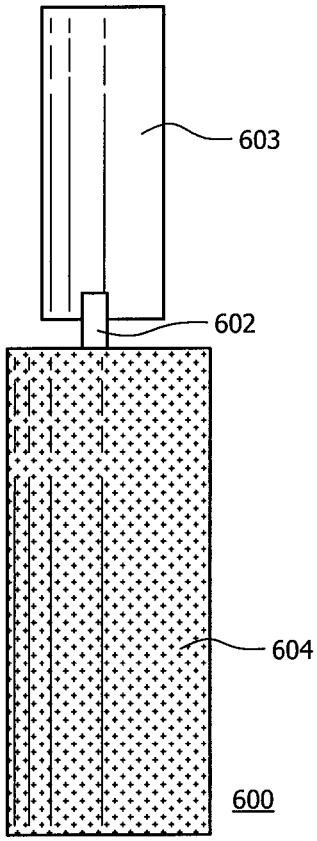
FIGS. 6A and 6B are illustrations of an exemplary antenna system adapted according to one embodiment of the invention, and each of FIGS. 6A and 6B illustrates a different rolling configuration.
Figure 6B:
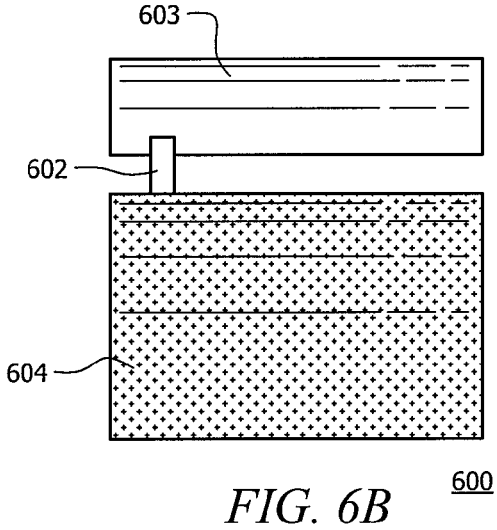

FIGS. 6A and 6B are illustrations of exemplary antenna system 600 adapted according to one embodiment of the invention, and each of FIGS. 6A and 6B illustrates a different rolling configuration. FIGS. 6A and 6B illustrate that various embodiments may include a ground plane (such as ground plane 604) on a flexible substrate that may also be rolled instead of, or in addition to, rolling a flexible substrate that includes an antenna element (such as flexible substrate 603) while retaining the performance properties described above with respect to FIGS. 3 and 4. Additionally, FIGS. 6A and 6B illustrate that either or both of a ground plane and a flexible substrate with an antenna element may be rolled lengthwise (as in FIG. 6A) or widthwise (as in FIG. 6B). Furthermore, while not shown herein, some embodiments may place an antenna element and a ground plane on the same flexible substrate.

Figure 7:
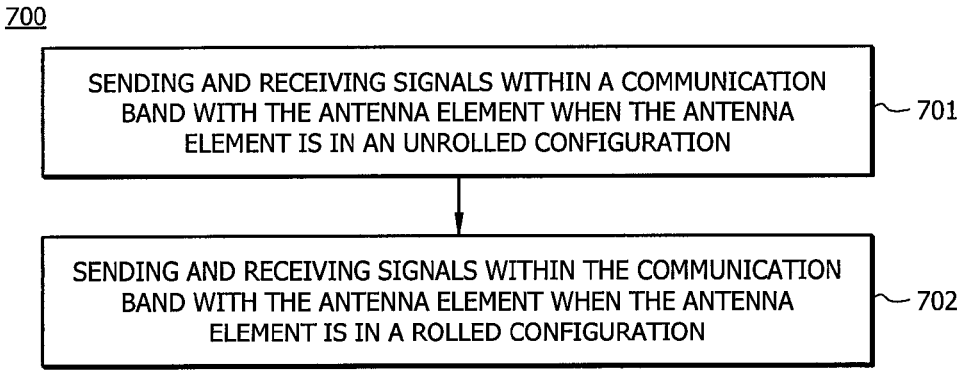
FIG. 7 is an illustration of an exemplary process adapted according to one embodiment of the invention for operating an antenna system, such as the antenna systems of FIGS. 1, 3, 5, and 6.

FIG. 7 is an illustration of exemplary process 700, adapted according to one embodiment of the invention for operating an antenna system, such as any of the antenna systems of FIGS. 1, 3, 5, and 6. In block 701, the antenna element is used to send and receive signals when it is in an unrolled configuration. The antenna element is used to communicate within a band, such as a discrete, single-use communication band (e.g., GSM 850/900, GSM 1800/1900, a IEEE 802.11 band, and/or the like). In block 702, the antenna element is used to send and receive signals when it is in a rolled configuration in the same communication band.

While FIG. 7 is shown as a series of discrete steps, various embodiments may add, omit, modify, or rearrange various actions. For instance, some embodiments include adjusting the configuration from rolled to unrolled, from unrolled to rolled, or from any arbitrary configuration to any other arbitrary configuration, even during operation of the antenna system.

Figure 8:
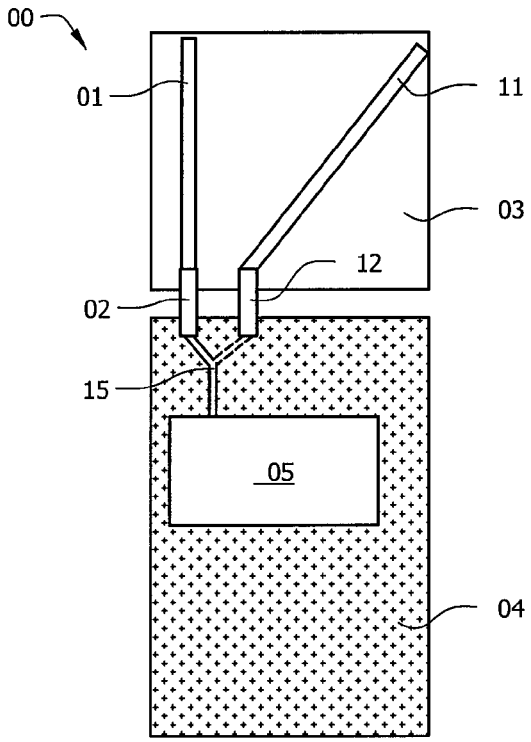
FIG. 8 is an illustration of an exemplary antenna system adapted according to one embodiment of the invention.

FIG. 8 is an illustration of exemplary antenna system 800, adapted according to one embodiment of the invention. System 800 includes ground plane 804 and flexible substrate 803. Flexible substrate 803 includes two antenna elements 801 and 811, which are in communication with RF module 805 through feeds 802 and 812, respectively, and switch 815. Switch 815 may include any kind of switch now known or later developed, such as a diode-based switch, a Microelectromechanical Systems (MEMS) switch, and the like.

In this example, antenna element 811 is disposed upon substrate 803 at an angle that minimizes or eliminates overlap with itself when rolled or folded. By contrast, antenna element 801 will experience much overlap with itself when rolled or folded. Thus, antenna element 801 would generally be expected to experience greater frequency shift when rolled or folded than would antenna element 811. One example embodiment may require a high degree of precise performance within a frequency band and use antenna elements 801 when flexible substrate 803 is flat, and use the other antenna element 811 when flexible substrate 803 is rolled. In system 800, RF module 805, or another separate device (not shown), includes a control system that selects antenna element 801 or antenna element 811 using switch 815. System 800 uses the control system to discern a rolled or unrolled status and to control switch 815 to select an appropriate antenna element depending on the rolled/unrolled status of flexible substrate 803. In this way, system 800 provides consistent operation within a desired communication band in any rolled or unrolled configuration.

In other embodiments with more than one antenna element, the multiple antenna elements can be operated at the same time, whether rolled or unrolled, e.g., in a Multiple Input Multiple Output (MIMO) application. Such an embodiment may include two or more antenna elements configured so as to minimize overlap when rolled or folded. Furthermore, such an embodiment may utilize separate RF modules for each antenna element or an RF module with two, independent input/output ports. The number of different antenna elements that may be disposed upon a substrate is not limited to one or two, but may be scaled for any of a variety of applications. Multiple-antenna systems that can be adapted according to one or more embodiments include MIMO applications, array applications, antenna diversity applications, and the like.

Figure 9:
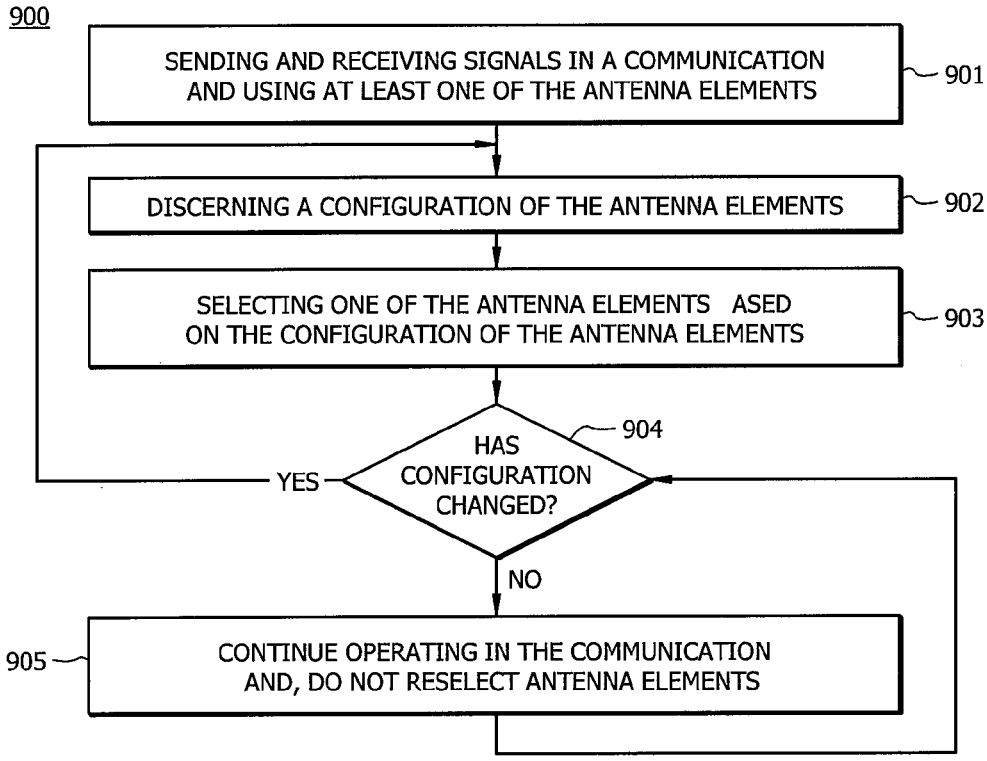
FIG. 9 is an illustration of an exemplary process 900 adapted according to one embodiment of the invention for operating an antenna system.

FIG. 9 is an illustration of exemplary process 900, adapted according to one embodiment of the invention for operating an antenna system, such as antenna system 800 of FIG. 8, wherein two antenna elements are adapted for use in different rolled/unrolled configurations. In block 901, the system sends and receives signals in a communication band using at least one of the antenna elements. As in process 700 (FIG. 7), the communication band can be a discrete, single-use communication band.

In block 902, a configuration of the antenna elements is discerned. For instance, the system may discern that the antenna elements and their accompanying substrate are rolled or unrolled. The action of block 902 may be performed in response to a change in configuration, periodically, in response to a user command and/or the like.

In block 903, one of the antenna elements is selected in response to the discerned configuration. For instance, if antenna element A is adapted for use in an unrolled configuration, and the discerned configuration is unrolled, then antenna element A is selected in block 903. On the other hand, if antenna element B is adapted for use in a rolled configuration, and the discerned configuration is rolled, then antenna element B is selected.

In block 904, it is discerned whether a configuration has changed. If the configuration has changed, then the new configuration is discerned in block 902. If the configuration has not changed, then the system does not reselect antenna elements in block 905. During operation, at least in this embodiment, the system regularly checks whether the configuration has changed by returning to block 904. Using process 900, the antenna system ensures satisfactory operation in at least one communication band in the rolled and unrolled configurations.

While FIG. 9 is shown as a series of discrete steps, various embodiments may add, omit, modify, or rearrange various actions. For instance, some embodiments include three or more antenna elements, where one or more antenna elements correspond to an unrolled configuration, and two or more antenna elements correspond to different degrees of rolling. Such embodiments include selecting various antenna elements depending on the degree of rolling and changing selection of antenna elements as the degree of rolling changes, even during operation of the antenna system.

Figure 10:
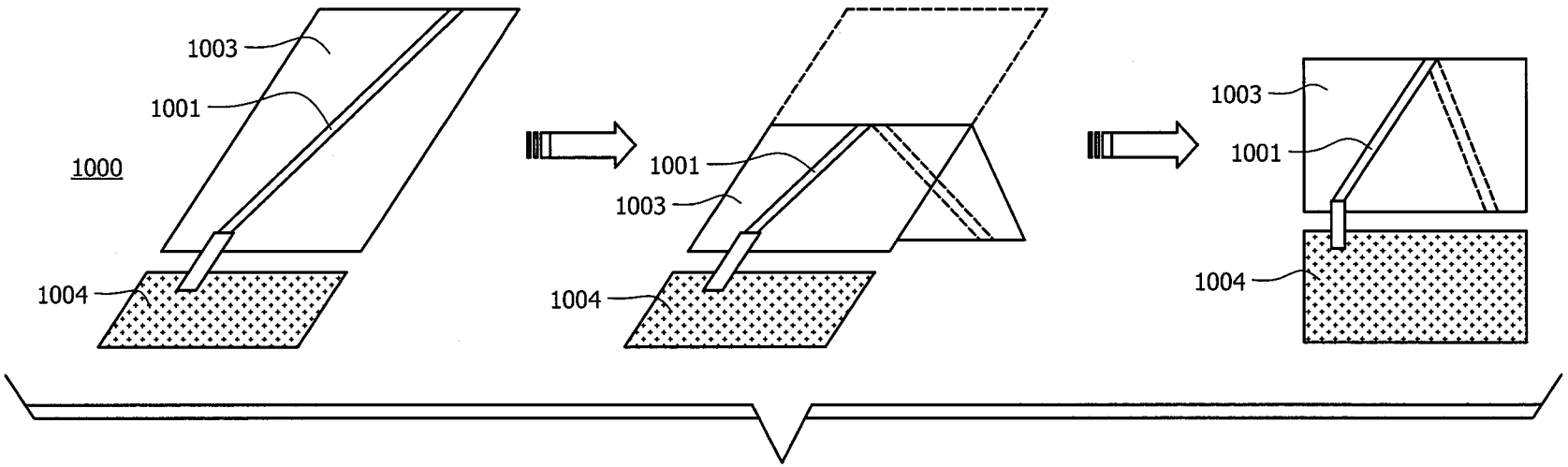
FIG. 10 is an illustration of an exemplary process adapted according to one embodiment of the invention for folding an exemplary antenna element.

While the embodiments illustrated above show antenna elements on flexible substrates that may be rolled and unrolled, other embodiments provide for folding alternatively to, or in addition to, rolling. FIG. 10 is an illustration of process 1000 adapted according to one embodiment of the invention for folding antenna element 1001, which is disposed upon flexible substrate 1003 and is proximate ground plane 1004. Process 1000 shows flexible substrate 1003 being folded once, but any number of folds permitted by the material may be used by some embodiments.

Furthermore, while the embodiments illustrated above show monopole-type antennas with a single metal path above a ground plane, other types of antennas may find use in other embodiments. For instance, various embodiments may use a patch antenna element, a Planar Inverted F Antenna (PIFA)-type element, a slot antenna element, a multi-band antenna element, etc.

Figure 11:
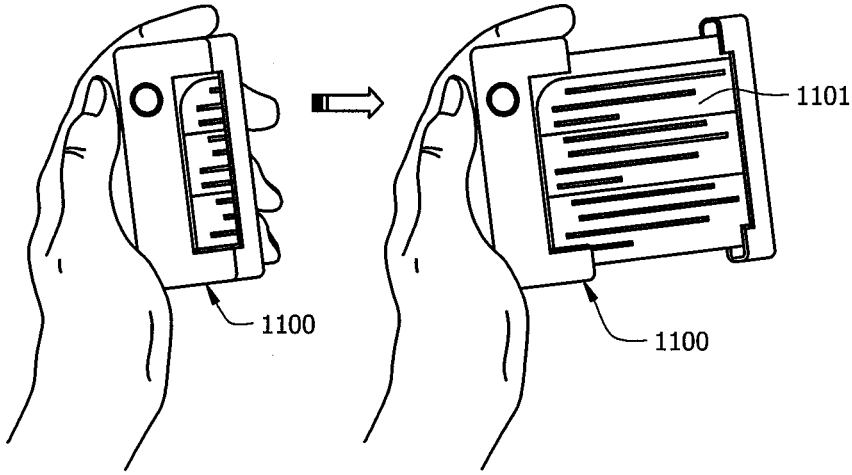
FIG. 11 is an illustration of an exemplary rollable screen device adapted according to one embodiment of the invention.
Figure 12:
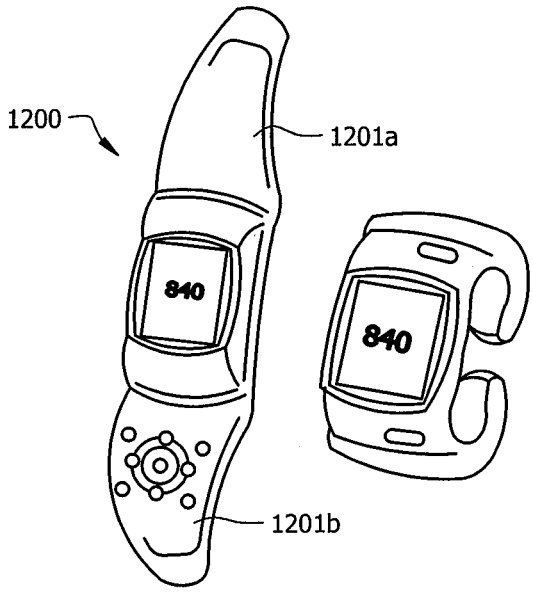
FIG. 12 is an illustration of an exemplary wrist phone device adapted according to one embodiment of the invention.

Various embodiments of the invention may be adapted for use in any of a variety of devices, such as, e.g., a walkie talkie, a rollable screen device, a wrist phone, an RF Identification (RFID) tag (e.g., applied to a flat, curved or creased surface), and the like. FIG. 11 is an illustration of exemplary rollable screen device 1100 adapted according to one embodiment of the invention. FIG. 11 shows rollable screen device 1100 both when screen assembly 1101 is rolled and unrolled. In the embodiment of FIG. 11, the antenna element (not shown) is integrated with screen assembly 1101, and the antenna element is rolled and unrolled as the user rolls and unrolls the screen. FIG. 12 is an illustration of exemplary wrist phone device 1200 adapted according to one embodiment of the invention. In this example, all or part of the antenna element (not shown) is integrated with the wrist phone so that when wrist band 1201 is open, the antenna element is substantially unrolled, and when wrist band 1201 is closed, the antenna element is at least partially rolled. Many embodiments can roll and unroll (or fold and unfold) flexible substrates and antenna elements using, e.g., a roller mechanism (as in the embodiment of FIG. 11), hinges (as in the embodiment of FIG. 12), and/or the like.

Various embodiments of the invention provide advantages over prior art antenna systems. For instance, rolling an antenna can provide for compactness and for conformance with various devices in many embodiments. Furthermore, various embodiments provide for rolling and unrolling with no perceptible loss of performance to a human user, since some embodiments operate in the same band when rolled or unrolled and operate with acceptable gain and efficiency even when rolled. Moreover, antennas in the past have been folded or rolled for transportation or storage, but no known systems employ folded or rolled antennas during use (especially not in a same operating band as when unfolded or unrolled).

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna system comprising:

a ground plane;

a flexible substrate;

a first antenna element disposed upon the flexible substrate and proximal to the ground plane, the flexible substrate configured so as to be at least partially rolled; and a Radio Frequency (RF) module in communication with the first antenna element and transmitting and receiving radio waves through the first antenna element;

wherein the first antenna element is arranged in a shape that minimizes overlap with itself when at least partially rolled, and wherein the first antenna element is configured to operate within a first frequency band when in an unrolled configuration and also configured to operate within the first frequency band when in a rolled configuration.

2. The antenna system of claim 1 further comprising:

a second antenna element in communication with the RF module, the RF module including circuitry that selects between the first and second antenna elements.

3. The antenna system of claim 1 further comprising means for rolling and unrolling the flexible substrate and the first antenna element, the rolling and unrolling means selected from the list consisting of:

a roller mechanism; and a hinge.

4. The antenna system of claim 1 comprising:

a walkie talkie;

a rollable screen device;

a wrist phone; and an RF Identification (RFID) tag.

5. The antenna system of claim 1 wherein the first antenna element comprises a monopole-type antenna element.

6. The antenna system of claim 1 wherein the flexible substrate is selected from the list consisting of:

flexible Printed Circuit Board (PCB); and plastic.

7. A method for operating an antenna, the antenna including an antenna element disposed upon a flexible substrate and a ground plane proximate the antenna element, the method comprising:

transmitting and receiving radio signals in a communication band when the flexible substrate is at least partially rolled, the communication band corresponding to a resonant frequency band of the antenna element in an unrolled configuration; and transmitting and receiving radio signals in the communication band when the flexible substrate is unrolled.

8. The method of claim 7 wherein the communication band is selected from the list consisting of:

a Global System for Mobile communication (GSM) frequency band;

an IEEE 802.11 frequency band.

9. The method of claim 7 wherein the communication band is a discrete, single-use band.

10. The method of claim 7 wherein the antenna element is arranged in a path away from the ground plane at a portion proximal to a feed element and toward the ground plane at a portion distal to the feed element.

11. A method for operating an antenna, the antenna including a first antenna element and a second antenna element disposed upon a flexible substrate, the method comprising:

selecting the first antenna element based on an amount of rolling of the flexible substrate; and transmitting and receiving radio signals using the selected first antenna element.

12. The method of claim 11 further comprising:

adjusting the amount of rolling of the flexible substrate; and selecting the second antenna element based on the adjusted amount of rolling of the flexible substrate.

13. The method of claim 11 wherein selecting the first antenna element comprises:

discerning the amount of rolling of the flexible substrate;

based upon the amount of rolling, activating a switch to communicatively couple the first antenna element to a port of a Radio Frequency (RF) device that facilitates the transmitting and receiving of the radio signals.

* * * * *